United States Patent [19]

Klein et al.

[11] Patent Number: 4,791,236

[45] Date of Patent: Dec. 13, 1988

[54] RELEASABLE FLEXIBLE CONDUCTIVE JACKET

[75] Inventors: Laurence R. Klein, Torrance; Walter A. Plummer, III, Santa Ana, both of Calif.

[73] Assignee: The Zippertubing Co., Los Angeles, Calif.

[21] Appl. No.: 72,216

[22] Filed: Jul. 10, 1987

[51] Int. Cl.[4] ..... H01B 7/34

[52] U.S. Cl. ..... 174/36; 138/166; 138/168; 174/35 GC; 174/DIG. 11; 428/100

[58] Field of Search ..... 174/36, DIG. 11, 35 GC; 428/100; 138/166, 168

[56] References Cited

U.S. PATENT DOCUMENTS

| | | | |
|---|---|---|---|
| 3,026,367 | 3/1962 | Hartwell | 174/35 GC |
| 3,413,406 | 11/1968 | Plummer | 174/35 GC |
| 3,464,094 | 9/1969 | Mates | 174/DIG. 11 X |
| 3,467,761 | 9/1969 | Plummer | 174/36 |
| 3,941,159 | 3/1976 | Toll | 138/156 X |
| 4,375,009 | 2/1983 | Fearnside et al. | 174/36 |
| 4,400,420 | 8/1983 | Bakken et al. | 428/100 X |
| 4,409,427 | 10/1983 | Plummer | 174/DIG. 11 X |
| 4,426,816 | 1/1984 | Dean et al. | 428/100 X |
| 4,457,068 | 7/1984 | Maier, Jr. | 138/168 X |
| 4,684,762 | 8/1987 | Gladfelter | 174/36 |

*Primary Examiner*—Morris H. Nimmo

*Attorney, Agent, or Firm*—Christie, Parker & Hale

[57] ABSTRACT

An electrically conductive removable jacket is provided for wire bundles or the like. The jacket comprises a flattened knitted metal wire tube with a strip of hook and loop fastener stitched along each longitudinal edge so that a tubular jacket is formed by overlapping the edges and securing the fasteners. Plural strips of hook and loop fastener assure that the jacket can be kept electrically "closed" regardless of the size of bundle encompassed. A resilient gasket is provided along one edge of the conductive jacket for making electrical contact with the opposite edge. The conductive jacket may be secured along one edge to one edge of a flexible electrically insulating jacket having fastening means along each edge for forming a tubular insulating jacket. The insulating jacket is inside of the conductive jacket.

8 Claims, 1 Drawing Sheet

RELEASABLE FLEXIBLE CONDUCTIVE JACKET

BACKGROUND OF THE INVENTION

This invention concerns an electrically conductive flexible sheath or jacket for wire bundles, pipes or the like. The jacket has longitudinal fastening means along its length for installation and removal.

For many years, flexible jackets have been marketed for wire bundles or the like. A representative jacket has an elongated plastic sheet with means along each longitudinal edge for securing the two edges together to form a tubular jacket. This edge-fastening means make take a variety of forms, as disclosed in U.S. Pat. Nos. 3,089,915; 3,234,614; 3,350,752; 3,808,665; 3,858,282 and 4,513,484 for example. Such a plastic jacket can be wrapped around a bundle of wire and the two moieties of the fastening means secured together to make a more or less cylindrical sheath surrounding the wire. Such jackets are used to keep the bundle of wires together.

It is sometimes desirable to contain a bundle of wires in an electrically conductive jacket so that the jacket can be grounded to prevent stray electrical fields from entering or leaving the wire bundle. Such a grounded jacket may be formed of braided wire which is slipped longitudinally over the bundle of wire. Clearly, this is inconvenient and may be impractical for very long wire bundles.

Such electrical shielding can also be provided by laminating flexible metal foil on one of a flexible removable plastic jacket, as described above. A grounding strap of braided wire may extend along the length of the jacket to improve electrical conductivity for grounding. When such a laminated jacket is wrapped around a wire bundle the contents can be electrically shielded.

In another embodiment, a knitted mesh of wire is stitched along an edge of a flexible plastic jacket. The same stitching may be used for securing a braided wire grounding strap in good electrical contact with the wire mesh. When such a jacket is secured tightly around a wire bundle, the edges of the mesh and grounding strap overlap to provide a substantially continuous electrically conductive layer around the bundle.

In such an embodiment, if the jacket envelops a wire bundle having a diameter appreciably smaller than the diameter of the jacket, the jacket will be loose on the bundle and can collapse. Continuity of the conductive jacket may be interrupted, thereby opening the bundle to electromagnetic interference.

There may also be instances where it is desirable to provide an electrically conductive jacket alone without the additional layer of electrical insulation.

It may also be desirable to provide the electrically conductive jacket of an insulating jacket. This might be used for example to sheath a conductive pipe carrying electrical wires. The external conductive jacket may provide extra grounding or a signal may be imposed thereon to mask any stray signals that might be broadcast from a conductive pipe. Such an embodiment may be useful for assuring secure communications.

Additional electrical shielding can also be important for avoiding effects of electromagnetic pulse which may disable sensitive electronic components. Similarly, shielding can alleviate problems from lightning strikes.

It is a common feature of these areas that it is desirable to have a flexible electrically conductive jacket that can be reliably placed around the pipe, bundle of wires of the like, without feeding it on from one end. It is desirable that the overlap of the edges of such a jacket be secured so that there is an electrically continuous jacket around a wire bundle. It is often desirable that this be accompanied by an electrically insulating layer similarly applied. Such a jacket should be lightweight, economical and reliable. It should be easily installed and removed without special facilities or equipment.

BRIEF SUMMARY OF THE INVENTION

There is, therefore, provided in practice of this invention according to a presently preferred embodiment, a flexible, electrically insulating sheet with interlocking means along each longitudinal edge for releasably securing the edges together to form a flexible tubular jacket. This is surrounded by an electrically conductive jacket from an elongated flexible electrically conductive sheet. A first strip, having one half of a flexible hook and loop fastener is provided on one face of the conductive jacket along one longitudinal edge. A second strip, having the other half of a flexible hook and loop fastener, is provided on the other face of the jacket along the other longitudinal edge. This permits the two longitudinal edges to be overlapped and secured together by the hook and loop fastener to form a tubular flexible electrically conductive shielding jacket outside of and concentric with the insulating jacket.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION

Figure 1:
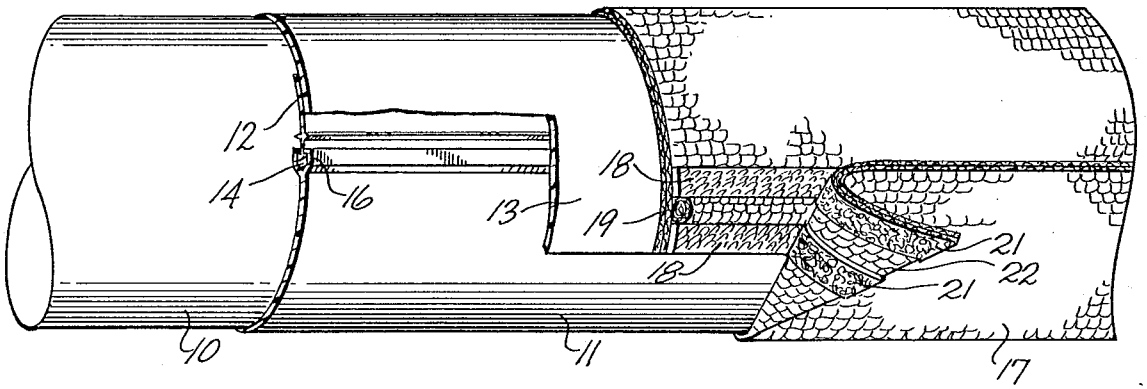
FIG. 1 illustrates in progressively cut-away side view a pipe surrounded by a flexible insulating and conductive jacket constructed according to principles of this invention.
Figure 2:
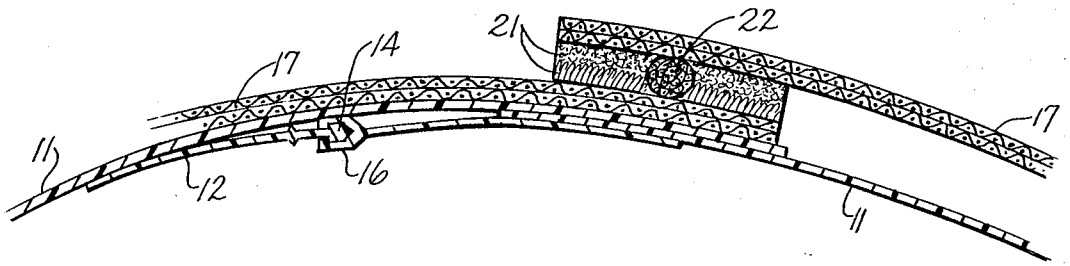
FIG. 2 is a fragmentary transverse cross-section of a closure for the insulating and electrically conductive jacket.

A double layer jacket is illustrated in FIG. 1 around a pipe 10. The item contained in the jacket is not of significance and it might for example be a bundle of wires or tubes instead of a pipe. In this drawing the layers of the jacket are successively cut away from the left edge of the drawing to better show the sequence and detail. The closure for the jacket is shown enlarged in a fragmentary cross section in FIG. 2 The inner layer comprises a flexible electrically insulating sheet 11, such as polyvinylchloride one half to one millimeter thick.

A fastener strip 12, is heat welded to the plastic sheet a short distance from one longitudinal edge and parallel thereto, thereby leaving a longitudinal edge of the plastic sheet as an overlapping flap 13. An arrowhead shaped bead 14 is formed along the free edge of the fastener strip 12. Along the opposite longitudinal edge of the plastic sheet there is a hollow bead 16, the interior of which is approximately complementary to the arrowhead bead. The arrowhead bead and hollow bead are two moieties of a longitudinal fastener along the length of the inner jacket which can be assembled or disassembled in a conventional manner. A variety of other shapes of fastening means may be provided along the longitudinal edges of the plastic sheet. For example, another type of fastener has two complementary "m"

shaped ridge and groove moieties that can be releasably interconnected along the length of the jacket. Such fastening means along the longitudinal edges of a plastic jacket are conventional.

The outer layer of the jacket comprises a knitted wire tube 17. It is conventional to knit tubing from wire having a diameter of 250 microns or less. Steel or copper wire has been used. A typical knitted tube is made from tin coated, copper clad, steel wire. The knitted tubing forms a wire mesh with openings considerable larger than the wire diameter. Even such open weave tubing can provide good electrical shielding when the opening size is small relative to the wave length of radiation shielded.

In a typical jacket provided in practice of this invention, a pair of concentric tubes of knitted wire are flattened to make a flat sheet with a width one half the circumference of the knitted tube. Thus, the jacket has four thicknesses of knitted mesh. If desired, a knitted tube may be folded in fourths, or two such knitted tubes may be overlapped to form four thicknesses of metal wire mesh. This provides higher electrical conductivity and generally smaller opening size in the conductive jacket without significantly decreasing the high degree of flexibility of the metal mesh. The wire mesh electrical shield and insulating jacket can also be separate tubes.

One longitudinal edge of the flexible wire mesh is stitched to the overlapping flap 13 of the plastic sheet. The same stitching secures two parallel strips 18 of conventional hook and loop fastener on the face of the metal mesh. The hook and loop fastener comprises two moieties, each of which comprises a fabric strip. One moiety has an array of small plastic hooks standing upright on the face of the strip. The other moiety has a plurality of flexible fiber loops for engagement with the hooks on the other fabric strip. When two such strips are pressed together the hooks entangle with the loops to secure the two moieties together. The two moieties can be peeled apart due to elastic deformation of the hooks. Suitable fabric strips of hook and loop fasteners are available from Velcro Industries N.V., Netherlands Antiles.

A resilient "gasket" 19, is secured in the gap between the fastener strips 18. In a preferred embodiment the gasket comprises a coil or roll of knitted wire mesh similar to the wire mesh 17 forming the outer layer of the flexible jacket. Such a roll of metal mesh may be made by knitting a tube of wire, flattening that tube, and rolling the flattened tube into a long coil. One edge of the roll can be doubled back over the outside of the gasket and held captive by the stitching securing the fastener strip 18, mesh 17 and overlapping flap 13. Alternatively, a coil of mesh can be encased in a tube (not shown) of knitted mesh having a larger diameter than the coil. Such a tube is then held captive by the aforesaid stitching, thereby securing the gasket in the gap between the fastener strips and preventing its unrolling.

By making the gasket of a roll of knitted metal mesh, the gasket is resilient as well as flexible to conform to a surface against which it may be placed.

A pair of parallel hook and loop fastener strips 21, are stitched to the flattened knitted wire mesh along the other longitudinal edge. These strips are spaced apart to leave a gap 22 where the underlying metal mesh is exposed. These second fastener strips 21 are on the opposite face of the metal mesh from the first fastener strips 18 straddling the gasket.

When the flexible jacket is wrapped around a pipe, wire bundle or the like, the plastic jacket is on the inside. The arrowhead bead 14 is pressed into the hollow bead 16 to interlock in a conventional manner to form a generally cylindrical tube around a wire bundle or the like. The free edge of the wire mesh (i.e. the edge that is not stitched to the plastic) is then wrapped around the plastic jacket. The two fastener strips 21 along that edge are pressed against the fastener strips 18 on the overlapping flap 13 of the plastic sheet. This not only secures the wire mesh into an electrically conductive tube around the plastic layer of the jacket, but also traps the resilient gasket 19 between the hook and loop strips 18 against the metal mesh exposed in the gap 22 between the opposing fastener strips. This assures good continuous electrical contact around the entire perimeter of the object encased in the insulated conductive jacket. Electrical contact is made along the edges of the jacket to have closed electrical shielding regardless of the bundle size inside the jacket. The pair of hook and loop fastener strips straddling the electrical connection keep the gasket and opposite metal mesh in engagement, and it is not necessary to keep the jacket tight on a wire bundle to have "closed" electrical shielding.

The good conductivity of the resilient coil of metal mesh in the gasket 19 helps provide longitudinal conductivity as a "grounding strap" to conduct current to the ends of the jacket. At the ends grounding may be provided by encircling the conductive jacket with a conventional braided metal strap or the like. Electrical connections can also be made to the jacket in between the ends since in this embodiment the conductive layer of the jacket remains exposed. Alternatively, the ends of the metal mesh may remain suitably isolated from ground in an embodiment where an electrical signal is applied to energize the metal mesh.

An external metal shield on the plastic jacket provides additional protection from abrasion, puncture or impact or sharp objects that may penetrate or damage the contents of the plastic jacket. The plastic jacket helps protect the wire bundle or the like encased therein from adverse weather, moisture, abrasion from vibration or movement, destructive gases and other hazards to the integrity of the wire. The metal jacket around the plastic jacket adds to the protection like a suit of chain mail armor. In an embodiment where the jacket is placed around a metal pipe or the like, the internal plastic jacket provides electrical insulation. This permits the pipe and sheath to be separately grounded or provided with other electrical contacts.

The outer layer of the jacket has a greater width than the inner layer to accommodate the greater diameter the outer layer must encompass. By making the two layers of different width the jacket can fit smoothly around a bundle or pipe without buckling the inner layer or stretching the outer layer.

Although, a flattened tube of knitted wire mesh is preferred for making the conductive jacket, other flexible conductive materials may also be employed. The metal mesh is preferred since it can have high electrical conductivity with a high degree of flexibility and resilience. This is significant where appreciable bends must accommodated by the jacket. Alternative materials include metal foil or preferably expanded metal foil such as copper. Expanded metal foil has an array of slits and is then stretched to form a reticulated web with diamond shaped openings. Such material is flexible and retains high electrical conductivity.

It will also be apparent that other types of resilient gasket may be used. For example, a plastic tube may be encased in metal mesh, foil or braid, and used in place of the coil of metal mesh. A plastic tube with metal wires braided around it may form an excellent high conductivity gasket.

Many other modifications and variations will be apparent to those skilled in this art. It will therefore be understood that within the scope of the appended claims this invention may be practiced otherwise than as specifically described.

What is claimed is:

1. An electrically conductive jacket comprising:

an elongated flexible electrically insulating sheet;

interlocking means along each longitudinal edge of the insulating sheet for releasably securing the longitudinal edges together to form a flexible tubular jacket;

an elongated flexible electrically conductive sheet having a greater width than the insulating sheet, and having one longitudinal edge secured along one longitudinal edge of the insulating sheet; and means along each longitudinal edge of the conductive sheet for releasably securing the longitudinal edges together in overlapping relation to form a flexible tubular jacekt outside of and concentric with the insulating jacket.

2. An electrically conductive jacket as recited in claim 1 further comprising a resilient electrically conductive gasket along a longitudinal edge of the conductive sheet for making electrical contact along the other longitudinal edge of the conductive sheet.

3. An electrically conductive jacket as recited in claim 1 wherein the insulating sheet and conductive sheet are secured together along a flap of the insulating sheet extending beyond the means for securing the edges of the insulating sheet together.

4. An electrically conductive jacket as recited in claim 3 wherein the means for securing the edges of the conductive sheet together comprises a first half of a hook and loop fastener secured to the conductive sheet and insulating sheet along the extending flap, and a second half of a hook and loop fastener secured along the other face of the conductive sheet along the opposite edge thereof.

5. An electrically conductive jacket as recited in claim 2 comprising a pair of parallel hook and loop fastener strips along each longitudinal edge of the conductive sheet and wherein the gasket is between the strips of one pair for engaging a gap between the strips of the other pair.

6. An electrically conductive jacket as recited in claim 1 wherein the electrically conductive sheet comprises a flattened knitted metal wire tube.

7. An electrically conductive jacket a recited in claim 6 further comprising a resilient electrically conductive gasket along a longitudinal edge of the conductive sheet for making electrical contact along the other longitudinal edge of the conductive sheet.

8. An electrically conductive jacket as recited in claim 1 wherein the resilient gasket comprises a roll of knitted wire mesh.

* * * * *